US005996126A

United States Patent [19]

Barthold et al.

[11] Patent Number: 5,996,126

[45] Date of Patent: Dec. 7, 1999

[54] CROWN PAD AND HEAD-PROTECTIVE HELMET

[75] Inventors: Michael J. Barthold, Flemington; Louis Orotelli, Washington Twp, both of N.J.

[73] Assignee: Cairns & Brother Inc., Clifton, N.J.

[21] Appl. No.: 09/119,913

[22] Filed: Jul. 22, 1998

[51] Int. Cl.[6] ..... A42B 3/00

[52] U.S. Cl. ..... 2/414; 2/410; 2/416; 2/420

[58] Field of Search ..... 2/410, 411, 414, 2/416, 417, 418, 419, 420

[56] References Cited

U.S. PATENT DOCUMENTS

| | | | |
|---|---|---|---|
| 1,602,727 | 10/1926 | Turner | 2/414 |
| 3,153,792 | 10/1964 | Marietta | 2/414 |
| 3,197,784 | 8/1965 | Carlisle | 2/420 |
| 3,551,911 | 1/1971 | Holden | 2/411 |
| 5,012,533 | 5/1991 | Raffler | 2/420 |
| 5,014,365 | 5/1991 | Schulz | 2/414 |

*Primary Examiner*—Michael A. Neas
*Assistant Examiner*—Gary L. Welch
*Attorney, Agent, or Firm*—R. Gale Rhodes, Jr.

[57] ABSTRACT

Crown pad of flexible material including a central body portion and a plurality of radially disposed members for flexing inwardly to conform to the crown of a person's head. The crown pad is for being connected to the central portions of head straps residing interiorly of a head-protective helmet. The flexible crown pad may be compressible causing the crown pad to attenuate or absorb some force or energy upon an object striking the helmet. A head-protective helmet in combination with such crown pad.

18 Claims, 5 Drawing Sheets

CROWN PAD AND HEAD-PROTECTIVE HELMET

BACKGROUND OF THE INVENTION

This invention relates to a crown pad particularly useful with a head-protective helmet and also relates to a head-protective helmet including such crown pad.

Numerous head-protective helmets are known to the prior art. Certain head-protective helmets include a plurality of flexible head straps, sometimes referred to in the art as a web or cradle of head straps, mounted interiorly of the helmet for engaging the head of a wearer of the helmet. Such head-protective helmets include a fireman's head-protective helmet and the present invention will be disclosed in the context of a fireman's head-protective helmet although it will be understood that the present invention is not so limited and is applicable to other head-protective helmets including a plurality of interior head straps which engage the head of the wearer of the helmet.

A fireman's head-protective helmet known to the art, typically includes an outer shell and a cradle or web of flexible head straps provided in the interior of the shell which engage and generally conform to the head of a wearer of the helmet. A head-protective helmet, e.g., a fireman's head-protective helmet is disclosed in U.S. Pat. No. 5,044,016, Christopher E. Coombs inventor, patented Sep. 3, 1991, and assigned to Cairns & Brother, Inc. of Clifton, N.J.; this patent is incorporated herein by reference as if fully reproduced herein. The head-protective helmet 10, FIG. 2, includes a hard outer shell 12 and an inner impact cap or attenuation liner assembly indicated generally as 14. A cradle 28 of a plurality of flexible web straps 30 resides interiorly of the helmet particularly interiorly of the attenuation liner assembly 14. Each strap 30 is formed of a strong flexible webbing, such as Nylon, stitched together at the central apex of the cradle 28, and proceeds from the apex to the rim 42 of the foam liner 26 at a notch formed in the rim 42. Each strap 30 wraps around the rim 42 and proceeds upwardly along the outer surface of the foam liner 26, is wrapped around a tube member 44 inset in a groove 46 formed in the outer surface of the liner 26 and then proceeds back around the lower rim 42 of the foam liner 26 to approach the apex as a free end with a loop 48. The loops 48 of the free ends of the straps 30 are collected, or interconnected, by draw string 50 knotted to allow adjustment of the cradle 28 to suit the individual head of a wearer of the helmet.

U.S. Pat. No. 5,517,691, patented May 21, 1996, Bruce H. Blake inventor, assigned to Lion Apparel, Inc., also discloses a head-protective helmet; this patent is incorporated herein by reference as if fully reproduced herein. This patent discloses a head-protective helmet, namely, a fire helmet 10 including an outer shell 20 and an impact attenuation system 30 including an impact cap 32 and a suspension system 40 including a plurality of flexible head straps 42–44 and an adjustable head band assembly 50. The outer ends of the flexible head straps 42–44 are mounted to the inner impact cap 32, as shown in FIG. 3, by a rib 46 residing in a recess 48. The flexible head strap 42–44 includes central head strap portions and as shown in FIG. 4, a circular crown pad 45 is associated with the flexible head straps 42–44 and is positioned at the central apex portion, or point of intersection, of the central head strap portions of the head straps 42–44. The circular crown pad 45 includes pairs of diametrically opposed slits through which the central head strap portions of the head straps 42–44 pass. For example, head strap 42 passes through a pair of diametrically opposed slits 45*a* and 45*b*.

While the above-noted structures included in the patents incorporated herein by reference have worked reasonably well in interconnecting the inner portion of a cradle or plurality of head straps residing in the interior of a head-protective helmet, it is believed that there exists a need in the art for a new and improved crown pad which is flexible so as to conform to the crown of the head of a wearer of the helmet into which the crown pad is incorporated. Still further, there appears to exist a need in the art for a crown pad which also absorbs or attenuates at least some of the energy or force directed to the head of a wearer of the helmet into which the crown pad is incorporated upon an object striking the helmet and forcing the helmet, and therefore the cradle or web of head straps downwardly against the head of the wearer of the helmet. There also appears to exist a need in the art for a head-protective helmet including a crown pad having the aforementioned features.

SUMMARY OF THE INVENTION

It is the object of the present invention to satisfy the foregoing needs in the art.

A crown pad satisfying such needs and embodying the present invention may include a body of flexible material including a plurality of radially disposed members. The crown pad is for being connected to the central portions of the plurality of head straps mounted interiorly of the head-protective helmet and the radially disposed members are for flexing inwardly toward the head of a wearer of the helmet to conform generally to the crown of the wearer's head. The flexible material may also be compressible whereby the crown pad will absorb or attenuate at least some of the force or energy which would otherwise be applied to the helmet wearer's head upon, for example, an object falling and striking the helmet.

A head-protective helmet satisfying the foregoing needs and embodying the present invention may include a plurality of interior head straps including inner or central portions, and a flexible crown pad including a plurality of radially disposed members. The crown pad is for being connected to the head straps central portions and the flexible members are for flexing inwardly and for conforming to the head of a wearer of the helmet. The crown pad may also be made of compressible material whereby upon an object striking the head-protective helmet at least a portion of the energy is attenuated or absorbed by the crown pad and not transferred to the helmet wearer's head.

DESCRIPTION OF THE DRAWINGS

FIG. 3 is a perspective view of the crown pad shown in FIGS. 1 and 2 with the plurality of radially disposed members shown flexed inwardly to conform to the head of a wearer of the helmet into which the crown pad may be incorporated and which FIG. 3 shows partial views of the inner or central portions of head straps extending through openings formed in the radially disposed members, the crown pad as shown in FIG. 3 is reversed or upside down from the crown pad as shown in FIGS. 1 and 2;

DESCRIPTION OF THE PREFERRED EMBODIMENT

Figure 1:
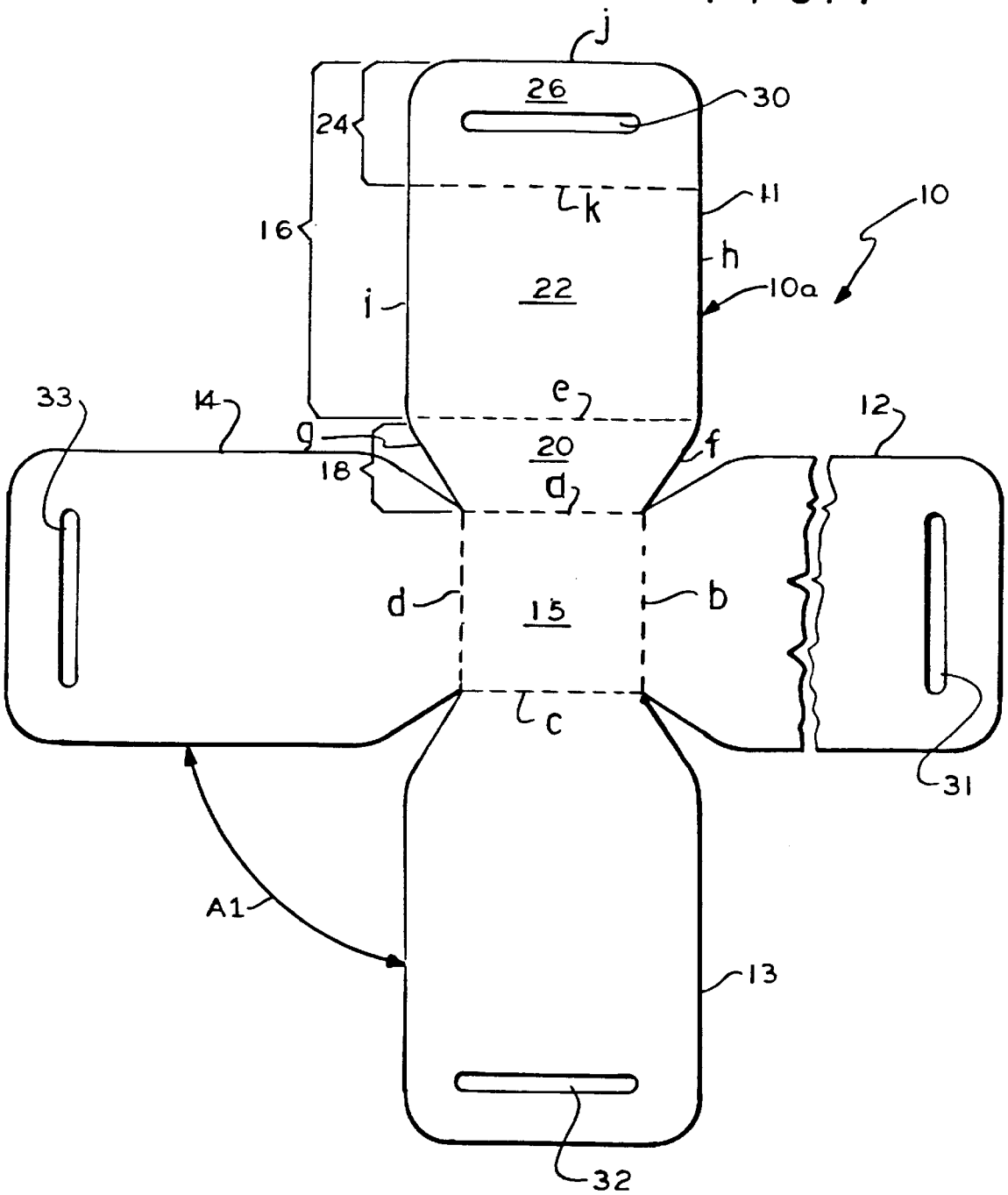
FIG. 1 is a plan view of a first embodiment of a crown pad embodying the present invention.
Figure 2:
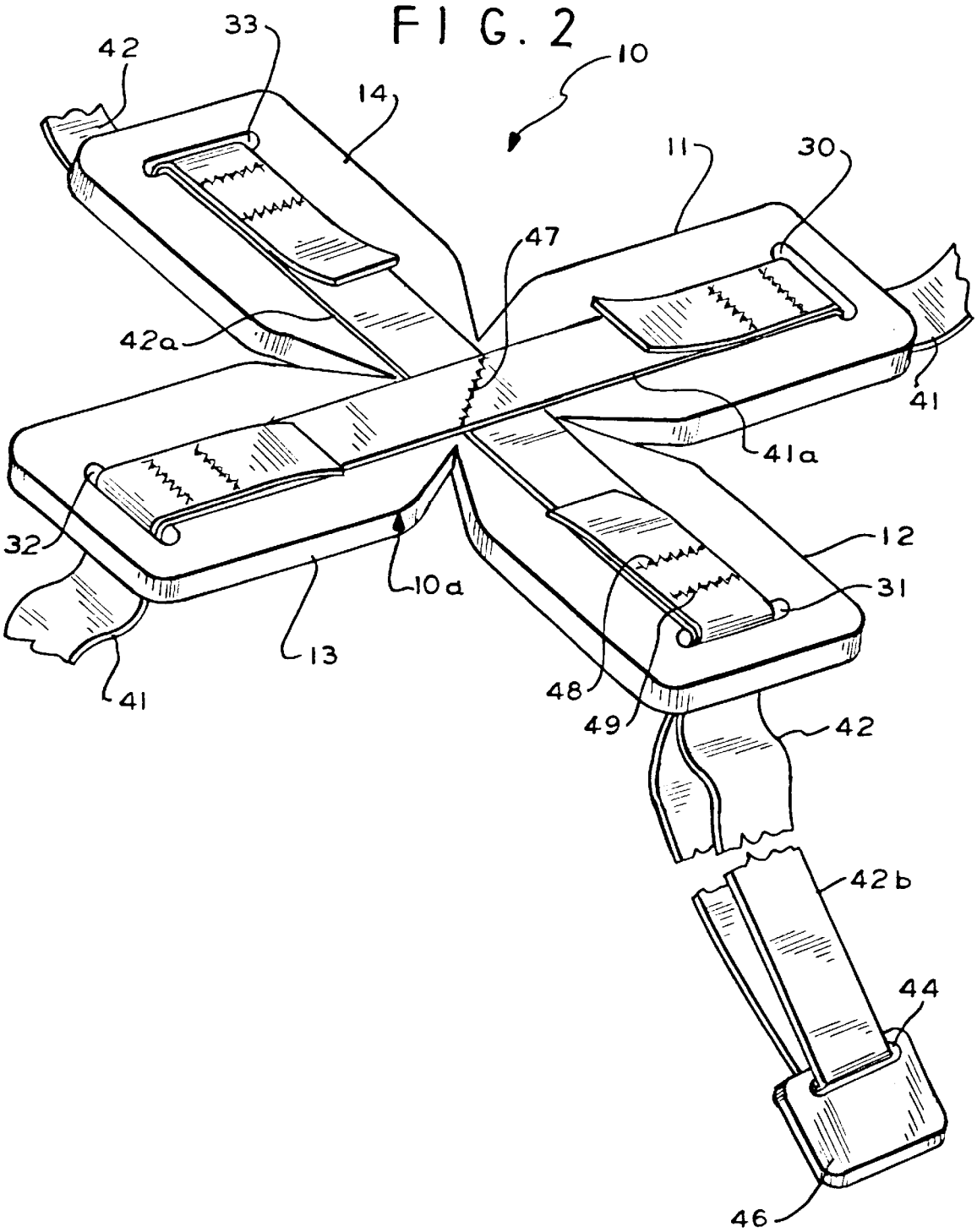
FIG. 2 is a perspective view illustrating the manner in which the central portions of a plurality of head straps mounted to the interior of a head-protective helmet extend through openings formed in the crown pad so as to extend over the central portion and plurality of radially disposed members comprising the crown pad.
Figure 3:
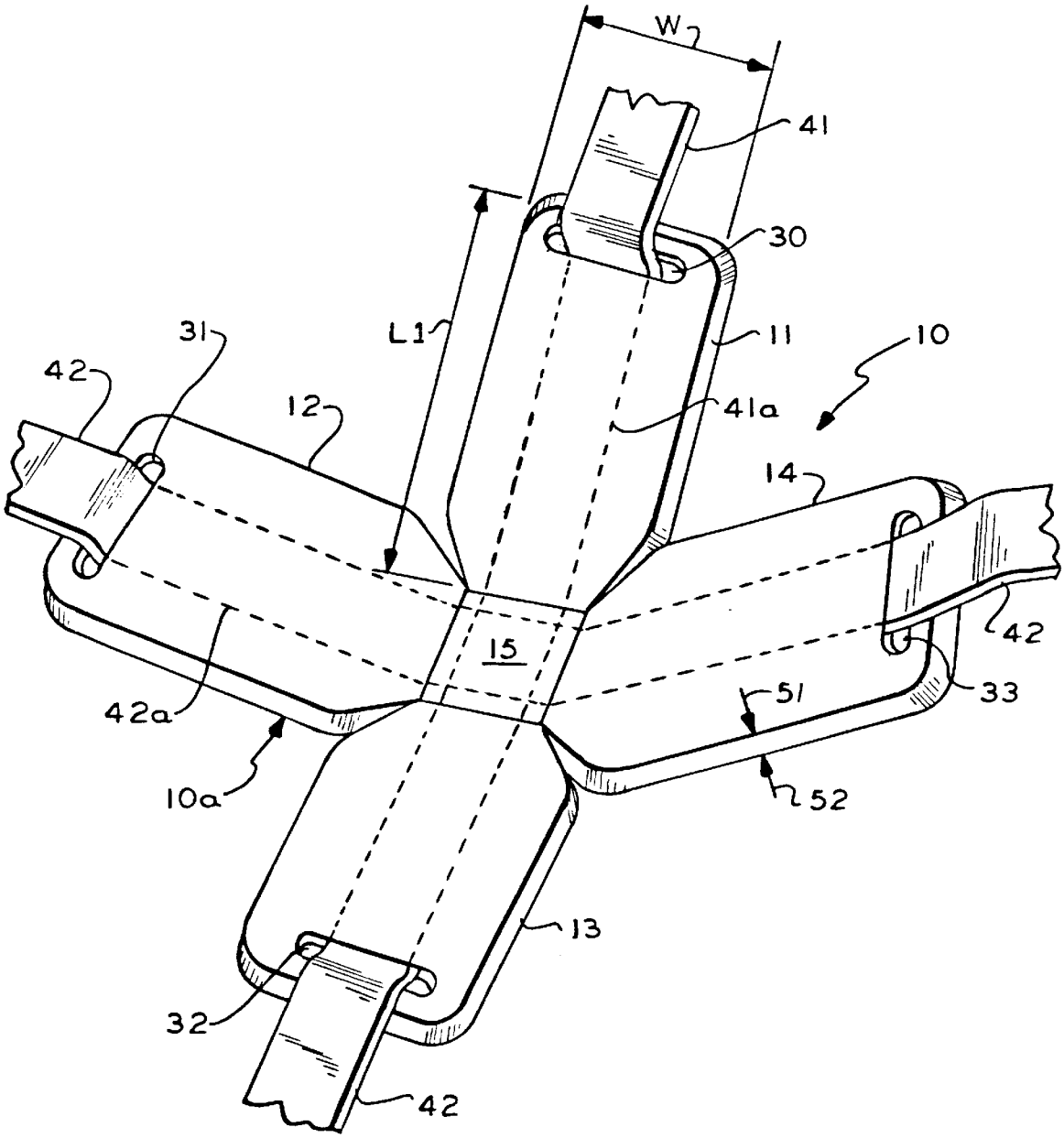

A first embodiment of a crown pad embodying the present invention is shown in FIGS. 1–3 and is indicated by general numerical designation 10. The crown pad 10, note particularly FIG. 1, comprises a body of flexible material indicated by general numerical designation 10*a* and includes a plurality of generally radially disposed members 11, 12, 13 and 14 formed integrally with and extending generally radially outwardly from a central portion 15 and being spaced angularly from each other as indicated by the arrow A1 in FIG. 1. The central portion 15, FIG. 1, is generally rectangular and is bounded by the rectangularly disposed dashed lines a, b, c and d.

Each radially disposed member, as will be understood from representative radially disposed member 11, shown in FIG. 1, includes a radially outer portion indicated by bracket 16 and a radially inner portion indicated by bracket 18. The radially outer portion 16, as will be noted from FIG. 1, is generally rectangular, and the radially inner portion indicated by the bracket 18 is generally trapezoidal decreasing in width radially inwardly toward the central portion 15. The radially inner portion is also identified by reference numeral 20 and is bounded by the dashed lines a and e and by the inclined solid lines f and g providing a portion of the outer boundary of the radially disposed member 11. The outer portion of representative radially disposed member 11 is also identified by numerical designation 22 and is bounded by the dashed line e and the solid lines h, i, and j forming a portion of the outer boundary of the representative radially disposed member 11. Further, the outer portion 22 of the representative radially disposed member 11 further includes an outer peripheral portion indicated by the bracket 24 and by reference numeral 26 and is bounded by a dashed line k, portions of the solid lines h and i and the solid line j. The outer peripheral portion 26 is provided with an opening 30 for receiving the central head strap portion of the flexible head strap comprising a cradle or web of flexible head straps mounted interiorly of a head-protective helmet, for example, a head-protective helmet of the types disclosed in the patents incorporated hereinabove by reference; the openings formed in the outer peripheral portions of the radially disposed members 12, 13 and 14 are identified respectively by reference numerals 31, 32 and 33 and such openings also are for receiving the central head strap portion of a flexible head strap.

In the preferred embodiment, the crown pad 10 is made of a suitable and commercially available low/medium density cross-linked polyethylene foam which is flexible, compressible and resilient.

As shown in FIG. 2, the central head strap portions 41*a* and 42*a* of a plurality of flexible head straps 41 and 42 comprising a cradle or web of head straps, of the type described above in the patents incorporated herein by reference, are laced, looped or extend through the respective pairs of diametrically opposed openings 30 and 32 and 31 and 33 provided respectively in the radially disposed members 11 and 13 and 12 and 14. It will be understood that the outer ends of the flexible head straps 41 and 42 may be mounted suitably, in the manner known to the art, to the outer hard shell of a head-protective helmet, or may be mounted to the inner impact cap of a head-protective helmet such as for example by use of the tube member 44 shown in FIGS. 2 and 4 of U.S. Pat. No. 5,044,016 incorporated by reference hereinabove or the ribs 46 shown in FIGS. 2 and 3 of U.S. Pat. No. 5,517,691 incorporated by reference hereinabove. Alternatively, as illustrated in the lower right-hand portion of FIG. 2 with regard to the outer portion 42*b* of representative flexible head strap 42, that the outer end of the head strap 42 may be looped through an opening 44 formed in a suitable mounting member, indicated diagrammatically by mounting member 46, and looped back upon itself and looped again through the opening 31 and folded or doubled back upon itself and stitched to itself as indicated diagrammatically by stitch lines 48 and 49; the diagrammatically indicated mounting member 46 may be used to mount the outer ends of the flexible head straps to, for example, either the outer hard shell of the head-protective helmet or the inner impact cap of the head-protective helmet. Similarly, the other outer ends of the flexible head straps may be mounted to suitable mounting members in the same manner. Additionally, the apex portions of the central head strap portions 41*a* and 42*a* may be suitably stitched together as indicated diagrammatically by stitch line 47. Referring still to FIG. 2, it will be noted that upon the central head strap portions 41*a* and 42*a* being received and extending through the respective pairs of diametrically opposed openings 30 and 32 and 31 and 33 the central head strap portions 41*a* and 42*a* extend respectively over the pairs of diametrically opposed radially disposed members 11 and 13 and 12 and 14 and over the central body portion 15 (FIG. 1).

As will be further understood from FIG. 3, the body of material, such as for example the above-noted low/medium density cross-linked polyethylene foam, is sufficiently flexible to permit the plurality of radially disposed members 11, 12, 13 and 14 to flex inwardly towards each other so as to conform to the crown of the head of a wearer of the head-protective helmet into which the crown pad is incorporated. It will be further understood that such body of material comprising the crown pad 10 is sufficiently compressible such that it will attenuate or absorb at least some of the energy or force produced upon an object striking or impacting a head-protective helmet into which the crown pad is incorporated and forcing the helmet, and thereby the head straps and crown pad, downwardly into engagement with the crown of the head of the wearer of the helmet. Still further, it will be understood that the body of material comprising the crown pad 10 is sufficiently resilient such that when the head-protective helmet is removed, the crown pad will generally return to its original shape.

As indicated by the opposed arrows 51 and 52 on radially disposed member 12 in FIG. 3, in the preferred embodiment, the crown pad had a thickness of about ¼ inch. Further, as indicated on radially disposed member 11 in FIG. 3, in the preferred embodiment, the radially disposed members had a length L1 of about 3 inches and a width W of about 1¾ inches. Also, in the preferred embodiment, the central portion 15 was a square of about 1 inch.

Figure 4:
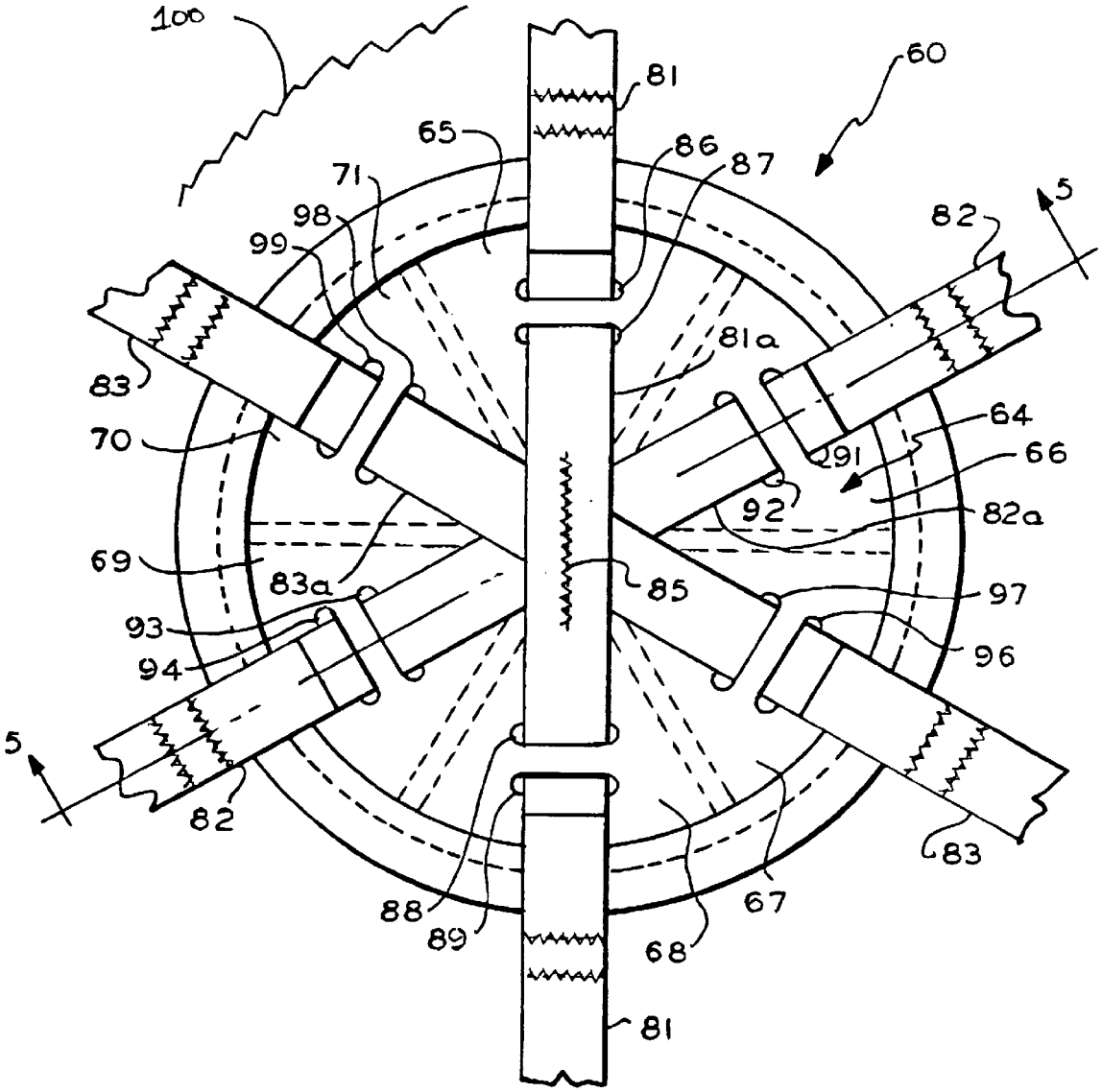
FIG. 4 is a plan view of an alternate embodiment of a crown pad embodying the present invention with portions of the inner or central portions of the interior head straps of a head-protective helmet being partially shown.
Figure 5:
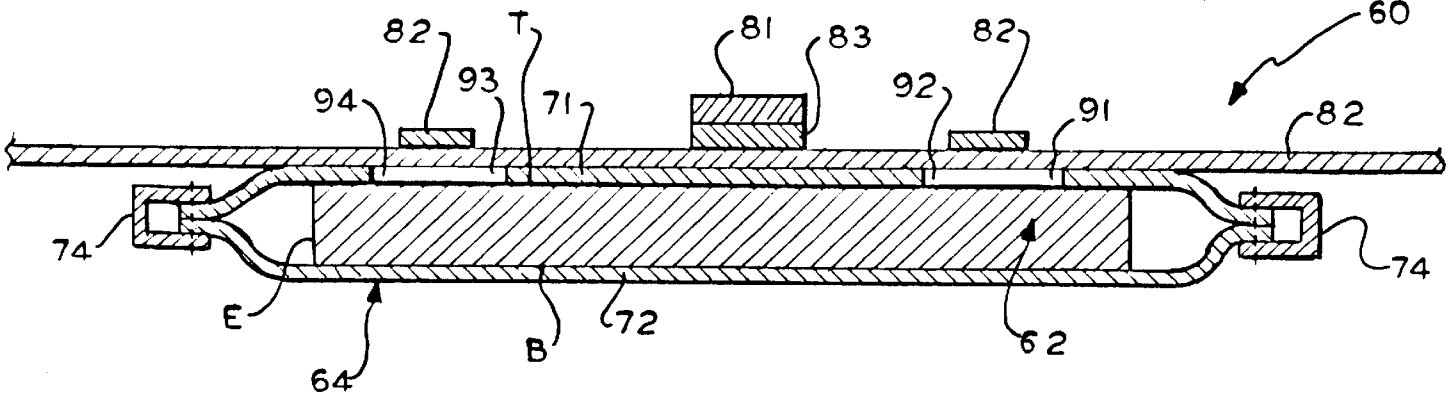
FIG. 5 is an enlarged cross-sectional view taken generally along the line 5—5 in FIG. 4 in the direction of the arrows.
Figure 6:
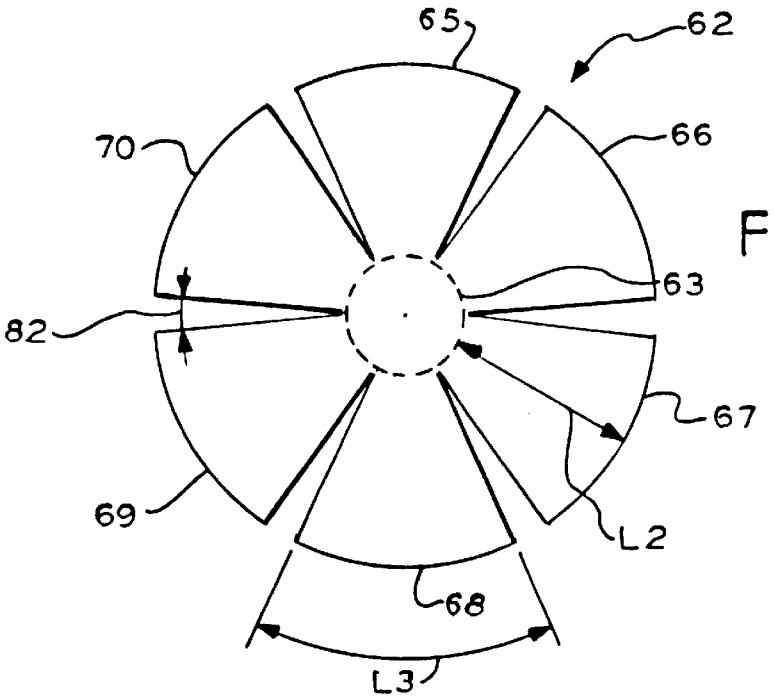
FIG. 6 is a plan view of a body of flexible material residing interiorly of the crown pad shown in FIGS. 4 and 5.

Referring now to FIGS. 4–6, a second embodiment of a crown pad embodying the present invention is shown and indicated by general numerical designation 60. The crown pad 60, as may be better understood by reference to FIGS. 5 and 6, includes an inner body of flexible material indicated by general numerical designation 62 and an outer layer of covering material surrounding the body of flexible material 62 and indicated in FIGS. 4 and 5 by general numerical designation 64. As will be best understood by reference to FIG. 6, the body of flexible material 62 is circular and includes a generally circular central body portion 63, as indicated by the dashed circle in FIG. 6, and a plurality of radially disposed members 65–70 extending generally radially outwardly from the central body portion 63 and being spaced angularly from each other as indicated by the double headed arrow 82 in FIG. 6. In the preferred embodiment, the body of flexible material 62 is generally circular, as shown in FIG. 6, and as will be further understood from FIG. 6 the plurality of radially disposed members 65–70 are sectors of a circle and further, in the preferred embodiment, the sectors, as indicated by representative sector 67, had a radial length L2 of about 1½ inches, had a radially outward arcuate length L3, as indicated by representative sector 68, of about 2⅛ inches and had a thickness of about ½ inch. Also, in the preferred embodiment, the body of flexible material 62 is made of a suitable and commercially available medium/high density cross-linked polyethylene foam which is flexible, compressible and resilient.

As shown in FIG. 5, the body of material 62 includes a circular top T, a circular bottom B, and a circular outer peripheral edge E. As will be further understood from FIG. 5, the outer layer of covering material 64 includes a top circular layer 71 of covering material covering the circular top T of the body of flexible material 62, a bottom circular layer 72 of covering material covering the circular bottom B of the body of flexible material 62 and, as further shown in FIG. 5, the outer peripheral edges of the top and bottom layers of covering materials 71 and 72 are covered and stitched together by an outer peripheral layer of binding covering material 74. Thus, it will be understood, that the top and bottom layers of covering materials 71 and 72, and the outer peripheral binding covering material 74, surround the body of flexible material 62. In the preferred embodiment, the layers of covering material were a suitably commercially available flannel.

Referring again to FIG. 4, a plurality of flexible head straps 81, 82 and 83, of the type noted above and shown in the patents incorporated by reference hereinabove, are shown and such flexible head straps include central head strap portions 81*a*, 82*a*, and 83*a* which are sewn together at their apex as indicated diagrammatically by stitch line 85. As illustrated in FIGS. 4 and 5, and in particular FIG. 4, the top layer of covering material 71 is provided with pairs of diametrically opposed openings 86 and 87 and 88 and 89; 91 and 92 and 93 and 94; and 96 and 97 and 98 and 99. As will be further understood from FIG. 4, the central head strap portions 81*a*, 82*a*, and 83*a* extend through the respective pairs of diametrically opposed openings 86 and 87 and 88 and 89, 91 and 92 and 93 and 94 and 96 and 97 and 98 and 99 to cause the central head strap portions 81*a*, 82*a*, 83*a* to extend over the respective diametrically opposed sectors 65 and 68, 66 and 69 and 67 and 70 of the body of flexible material 62, and across the central body portion 63 (FIG. 6) of the body of flexible material 62.

The outer ends of the flexible head straps 81, 82 and 83 may be connected to suitable mounting members to mount the outer ends of such head straps, for example, to either the outer hard shell of a head-protective helmet or the inner impact cap of a head-protective helmet in the same manner described above with regard to the outer end of the head strap 42 and mounting member 46 shown in FIG. 2; such head-protective helmet is indicated diagrammatically in FIG. 4 by numerical designation 100 and which helmet, for example, may be a head-protective helmet disclosed in U.S. Pat. No. 5,044,016 or the head-protective helmet disclosed in U.S. Pat. No. 5,517,691 which patents are incorporated by reference hereinabove.

Accordingly, it will be understood that upon force being applied to the head-protective helmet into which the crown pad 60 is incorporated in the manner described above, the plurality of radially disposed members 65–70, FIG. 6, will deform generally inwardly towards each other, in the same manner as the plurality of radially disposed members 11, 12, 13 and 14 shown in FIG. 3, and will generally conform to the crown of the head of a wearer of the head-protective helmet into which the crown pad 60 is incorporated.

Further, in the preferred embodiment, the body of flexible material 62 is a body of flexible and compressible material whereby upon the crown pad 60 being forced into engagement and conforming to the crown of the head of a wearer of the helmet, the body of flexible and compressible material 62 will absorb or attenuate at least a portion of the force or energy that would be otherwise transferred to the helmet wearer's head upon, for example, an object falling and striking the head-protective helmet into which the crown pad 60 is incorporated and which helmet is being worn on the head of a person.

Also, the body of flexible and compressible material 62 may also be a body of flexible, compressible and resilient material whereby upon the head-protective helmet into which the crown pad 60 is incorporated is removed from the helmet wearer's head, the crown pad 60 will generally return to its original shape.

It will be understood that many variations and modifications may be made in the present invention without departing from the spirit and the scope thereof.

What is claimed is:

1. A crown pad for being mounted to the interior of a head-protective helmet including a plurality of interior head straps including central head strap portions, comprising:

a body of flexible material including a central body portion and a plurality of radially disposed members formed integrally with and extending generally radially outwardly from said central body portion and being spaced angularly from each other, said plurality of radially disposed members including a plurality of outer peripheral portions provided with a plurality of pairs of generally diametrically opposed elongated openings for receiving said central head strap portions to cause said central head strap portions to extend over said central body portion and plurality of radially disposed members, said elongated openings disposed generally transversely with respect to said plurality of radially disposed members.

2. The crown pad according to claim 1 wherein said body of flexible material is a body of flexible and compressible material and wherein upon force being applied to the helmet said body of flexible and compressible material being forced into engagement with and the crown of the head of a wearer of the helmet and said body of flexible and compressible material attenuating or absorbing at least a portion of the force and said plurality of radially disposed members deforming generally inwardly towards each other and generally conforming to the crown of the head of the wearer of the helmet.

3. The crown pad according to claim 2 wherein said plurality of generally radially disposed members are a plurality of generally longitudinally extending generally radially disposed members including inner portions and outer portions, wherein said inner portions are generally trapezoidal portions and are formed integrally with and decrease in width towards said central body portion and wherein said outer portions are generally rectangular portions and include outer peripheral portions in which pairs of generally diametrically opposed openings are formed to provide said opening means.

4. The crown pad according to claim 3 wherein said plurality of generally longitudinally extending generally radially disposed members comprise pairs of generally diametrically opposed generally longitudinally extending members and wherein said pairs of generally diametrically opposed openings are for receiving the central head strap portions to cause the central head strap portions to extend over said pairs of generally diametrically opposed generally longitudinally extending members and said central body portion.

5. The crown pad according to claim 1 wherein said crown pad is generally circular and includes a top, a bottom, and a circular edge, wherein said crown pad further comprises a layer of covering material surrounding said body of flexible material and including a top cover layer portion covering said top, said top cover layer portion provided with a plurality of pairs of generally diametrically opposed openings providing said opening means.

6. The crown pad according to claim 5 wherein said plurality of generally radially disposed members are a plurality of generally radially disposed sectors of a circle.

7. The crown pad according to claim 6 wherein the plurality of generally radially disposed sectors of a circle comprise a plurality of generally diametrically opposed pairs of sectors of a circle and wherein said pairs of generally diametrically opposed openings are for receiving said central head strap portions to cause said central head strap portions to extend over said pairs of generally diametrically opposed sectors of a circle and said central body portion.

8. The crown pad according to claim 7 wherein said plurality of pairs of generally diametrically opposed sectors of a circle are equal in number to said plurality of interior head straps.

9. The crown pad according to claim 1 wherein said plurality of generally radially disposed members are equal in number to said plurality of interior head straps.

10. Crown pad, comprising:

a body of flexible material including a central body portion and a plurality of generally radially disposed members formed integrally with and extending radially outwardly from said central body portion and being spaced angularly from each other, said plurality of generally radially disposed members for flexing inwardly towards each other to generally conform to the crown of a person's head, said plurality of radially disposed members including a plurality of outer peripheral portions provided with a plurality of pairs of generally diametrically opposed pairs of elongated openings, said elongated openings disposed generally transversely with respect to said plurality of radially disposed members.

11. Apparatus for protecting a person's head, comprising:

head-protective helmet means having an interior and for being worn on and for protecting the person's head, said head-protective helmet means including a plurality of head straps residing in said interior of said head-protective helmet means and for engaging a portion of the person's head, said plurality of head straps including generally central head strap portions and outer portions mounted to said head-protective helmet means; and a flexible crown pad residing in said interior of said head-protective helmet means and for engaging and conforming the crown of a person's head, said crown pad including a central body portion and a plurality of generally radially disposed members formed integrally with and extending generally radially outwardly from said central body portion, and said crown pad including opening means providing a plurality of pairs of generally diametrically opposed openings through which said central head strap portions extend to cause said central head strap portions to extend over said central body portion and said plurality of generally radially disposed members.

12. The apparatus according to claim 11 wherein said body of flexible material is a body of flexible and compressible material and wherein upon force is applied to the helmet said body of flexible and compressible material being forced into engagement with and the crown of the head of a wearer of the helmet, said body of flexible and compressible material attenuating or absorbing at least a portion of the force and said plurality of radially disposed members deforming generally inwardly towards each other and generally conforming to the crown of the head of the wearer of the helmet.

13. The apparatus according to claim 11 wherein said plurality of generally radially disposed members are a plurality of generally longitudinally extending members including inner portions and outer portions, wherein said inner portions are generally trapezoidal portions and are formed integrally with and decreasing in width towards said central body portion and wherein said outer portions are generally rectangular portions and include outer peripheral portions in which openings are formed to provide said opening means.

14. The apparatus according to claim 11 wherein said plurality of generally longitudinally extending members comprise pairs of generally diametrically opposed generally longitudinally extending members and wherein said central head strap portions extend over said pairs of generally diametrically opposed generally longitudinally extending members and said central body portion.

15. The apparatus according to claim 11 wherein said crown pad is generally circular and includes a top, a bottom, and a circular edge, wherein said crown pad further includes a layer of covering material surrounding said crown pad and including a top cover layer portion covering said top, said top cover layer portion provided with said plurality of pairs of generally diametrically opposed openings providing said opening means.

16. The apparatus according to claim 15 wherein said plurality of radially disposed members are a plurality of radially disposed sectors of a circle.

17. The apparatus according to claim 16 wherein the plurality of generally radially disposed sectors of a circle comprise a plurality of generally diametrically opposed pairs of sectors of a circle and wherein said central head strap portions extend over said pairs of generally diametrically opposed sectors of a circle and said central body portion.

18. The apparatus according to claim 1 wherein said plurality of generally radially disposed members are equal in number to said plurality of interior head straps.

* * * * *